US012404060B2

(12) United States Patent
Biondi et al.

(10) Patent No.: US 12,404,060 B2
(45) Date of Patent: Sep. 2, 2025

(54) UNIT AND METHOD FOR THE MOVEMENT AND FILLING OF A CONTAINER, APPARATUS WITH SUCH A UNIT

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT); Giacomo Noferini, Bologna (IT); Cristian Dakessian, Bologna (IT)

(73) Assignee: G.D S.P.A., Bologna (IT)

( * ) Notice: Subject to any disclaimer, the term of this patent is extended or adjusted under 35 U.S.C. 154(b) by 89 days.

(21) Appl. No.: 17/998,348

(22) PCT Filed: Jul. 26, 2021

(86) PCT No.: PCT/IB2021/056709
§ 371 (c)(1),
(2) Date: Nov. 9, 2022

(87) PCT Pub. No.: WO2022/023925
PCT Pub. Date: Feb. 3, 2022

(65) Prior Publication Data

US 2023/0227192 A1 Jul. 20, 2023

(30) Foreign Application Priority Data

Jul. 31, 2020 (IT) ..... 102020000018850

(51) Int. Cl.
*B65B 43/50* (2006.01)
*B65B 1/12* (2006.01)
(Continued)

(52) U.S. Cl.
CPC ..... *B65B 43/50* (2013.01); *B65B 1/12* (2013.01); *B65B 29/022* (2017.08); *B65B 43/59* (2013.01)

(58) Field of Classification Search
CPC ..... B65B 43/50
See application file for complete search history.

(56) References Cited

U.S. PATENT DOCUMENTS 4,119,310 A * 10/1978 Trubody ..... A63G 1/14 188/82.9
8,465,274 B2 * 6/2013 Borgatti ..... B29C 49/36 425/540
(Continued)

FOREIGN PATENT DOCUMENTS

EP 3040285 A1 7/2016
FR 3018774 A1 9/2015
WO 2016/020822 A1 2/2016

OTHER PUBLICATIONS

International Search Report and Written Opinion for International Application No. PCT/IB2021/056709 filed on Jul. 26, 2021 on behalf of G.D S.P.A. Mail Date: Aug. 7, 2021 11 pages.

*Primary Examiner* — Daniel Jeremy Leeds
(74) *Attorney, Agent, or Firm* — Steinfl + Bruno LLP

(57) ABSTRACT

A movement and filling unit of a container includes a movement and filling equipment. The equipment includes in turn: a frame, a metering member configured to release a filling product through a release opening, a movement device moveably secured to the frame, a housing with at least one seat, secured to the movement device. The movement device is configured to move the at least one seat along a movement trajectory where the following positions are defined: a removal position in which the container is housed in the at least one seat, a filling position in which the at least one seat is vertically aligned at a position under the release
(Continued)

opening, and a release position in which the container with the product is removed from the at least one seat.

16 Claims, 6 Drawing Sheets

(51) Int. Cl.
*B65B 29/02* (2006.01)
*B65B 43/59* (2006.01)

(56) References Cited

U.S. PATENT DOCUMENTS

| | | | | |
|---|---|---|---|---|
| 11,305,904 | B2 * | 4/2022 | Gallaun | B65B 43/16 |
| 2015/0027085 | A1 | 1/2015 | Rea et al. | |
| 2015/0027585 | A1 | 1/2015 | Mengibar Rivas | |
| 2016/0347484 | A1 | 12/2016 | Rea et al. | |

* cited by examiner

UNIT AND METHOD FOR THE MOVEMENT AND FILLING OF A CONTAINER, APPARATUS WITH SUCH A UNIT

CROSS REFERENCE TO RELATED APPLICATIONS

The present application is the US National Stage of International Patent Application No. PCT/IB2021/056709, filed on Jul. 26, 2021, which in turn, claims priority to Italian Application No. IT 102020000018850, filed on Jul. 31, 2020.

The present invention relates to a movement and filling unit and a movement and filling method for moving and filling a container as well as to an article production apparatus correlated thereto.

In particular, the container under consideration is also configured to be used as a loose article.

The present invention finds a preferred, although not exclusive, application in the sector of realising containers for loose articles such as capsules of infusion type products, for example coffee, a field to which reference can be made hereinafter without losing generality.

A movement and filling unit generally comprises devices which are suitable for moving the object of interest and metering members in charge of filling it.

Typically, the containers pertaining to this technical field are products having a capsule shape (i.e. substantially truncated conical upturned with the widest portion upwards) and made of semi-finished polymeric materials.

Generally, the capsule movement step is carried out by means of a device that moves integrally with a transporter so as to intermittently reach different stations, including, for example, the filling station.

Typically, the various single discrete process steps envisaged are carried out in single stations in which the capsule is brought by the transporter.

In this context, a process is said "continuous" when at each time coordinate the transporter that moves the container has a speed other than zero. This considered speed is the speed of the transporter during any processing step that leads to the coupling of the component with the container with respect to a fixed reference system and is intended as the speed of the transporter in its entirety.

In this context, the term "container" identifies a structure which is formed so to be able to contain material within it and in particular to be able to confine it at least laterally. In this sense, the material is considered to be "laterally confined" when the shape of the container is such as to retain the material within it even when the container, in its normal condition of use by a user, is inclined with respect to the support plane by a predetermined angle.

This container can be formed by one or more walls according to the content thereof or to specific aesthetic or functional reasons. For example, the container may be a box-shaped body capable of receiving powder, liquid, gel or similar products inside.

According to another example, the container may be cup-shaped or hemispherical and thus composed by only a curved wall. In this case, this curved wall comprises a central base portion which can preferably act as a support surface and a lateral crown which extends radially from the aforesaid base portion and is shaped so as to confine the product inside the container during the envisaged filling or use operations.

In this context the term "container" can be correlated with the term "capsule" of which it is considered to be a broader and more general formulation.

In this context, a first element is defined as "engaged" with a second element when an interaction is established between the two elements such that the first element is able to determine the positioning of the second element. This interaction may be, for example, of a mechanical, magnetic or other nature.

An orientation is said "horizontal" when it is parallel to the ground plane in which the unit object of the invention is installed.

Consistently, the term "vertical" identifies a direction perpendicular to the horizontal plane and so must be understood the terms relating to "higher, lower, upward or downward" positions or movements that refer to an orientation along the vertical direction.

In this context, the term "selectively" indicates a method for using a device or similar technical element that allows to freely activate or deactivate it according to preference and also, in case of a plurality of usable devices being present, to select which ones to activate simultaneously.

In this context, the term "stable" indicates an engagement of an object with respect to a constraint element for which this object does not change its spatial position while it is retained in this way.

The Applicant has observed that the processes generally carried out by the capsule movement and filling apparatuses provide for the filling step to be carried out by means of external devices comprising special metering members.

This condition therefore implies that the equipment in charge of moving the container moves intermittently at the external device in charge in order to carry out the desired process step.

This necessary fragmentation of the envisaged steps into different single moments and positions of the equipment means that the resultant of the totality of the required processing times is high or in any case not contained.

The Applicant has noted that this process method involves non-optimal processing times and highly uneven movement speeds of the container.

In addition, the Applicant has noted that all these separate steps of moving the container are further problematic when the filling product is present in the container, which, due to the volatility thereof, can be unintentionally spilled from the container.

The Applicant has also pointed out that the metering members that are normally used are very sensitive devices to the variations and the movements and that their possible accelerations or decelerations in space induce a high risk of modifying the quantities of product dispensed in an unpredictable manner, thus compromising the reproducibility of the process used.

The Applicant has therefore perceived that it was advantageous to start the container movement and filling process trying to overcome the fragmentary and intermittent approach of the prior art by trying to minimise the total movements of the container and at the same time to reduce the accidental movement of the filling product.

The Applicant has finally found that the desired optimisation of the aforementioned processes is achieved by producing a movement and filling unit for a container which is capable of moving the latter effectively, minimising the necessary movements and therefore also the possible unwanted losses of filling product during the envisaged processing steps.

In particular, in a first aspect thereof, the invention relates to a movement and filling unit for a container comprising a movement and filling equipment.

Preferably, said movement and filling equipment comprises a frame.

Preferably, said movement and filling equipment comprises a metering member which is configured to release a predetermined dose of a filling product by means of a release opening.

Preferably, said movement and filling equipment comprises a movement device which is secured with an ability to move with respect to said frame.

Preferably, said movement and filling equipment comprises a housing which is secured to said movement device.

Preferably, said housing comprises at least one seat.

Preferably, said movement device is configured to move said at least one seat along a movement trajectory in which there can be defined a removal position in which said container is housed in said at least one seat.

Preferably, said movement device is configured to move said at least one seat along a movement trajectory in which there can be defined a filling position in which said at least one seat is vertically aligned at a position under said release opening.

Preferably, said movement device is configured to move said at least one seat along a movement trajectory in which there can be defined a release position in which said container provided with said product is removed from said at least one seat.

In this way it is possible to move a container by means of a single movement device in such a manner that it reaches both a removal position and a filling and release position that are part of the same predetermined movement trajectory.

Thanks to this technical solution, the totality of the process times is reduced with respect to the embodiments present in the state of the art, thus determining an increase in the productivity of the system used.

In a second aspect thereof, the invention relates to a movement and filling method for moving and filling a container, comprising providing a movement and filling unit.

Preferably, said movement and filling unit comprises a movement and filling equipment comprising a frame.

Preferably, said movement and filling equipment comprises a metering member which is configured to release a predetermined dose of a filling product by means of a release opening.

Preferably, said movement and filling equipment comprises a movement device which is secured with an ability to move with respect to said frame.

Preferably, said movement and filling equipment comprises a housing which is secured to said movement device and comprising at least one seat.

Preferably, said movement device is configured to move said at least one seat along a movement trajectory in which there can be defined a removal position in which said container is housed in said at least one seat, a filling position in which said seat is vertically aligned in a position under said release opening, a release position in which said container with said product is removed from said at least one seat.

Preferably, said movement and filling method for moving and filling a container comprises moving said housing by positioning it at a removal seat in which a container is positioned for each of said at least one seat.

Preferably, said method for moving and filling a container comprises moving said housing by bringing said housing into a filling position in which said seat is vertically aligned in a position under a release opening of a metering member comprised in said movement and filling equipment.

Preferably, said movement and filling method for moving and filling a container comprises releasing a desired dose quantity of a product inside said container by means of said metering member.

Preferably, said movement and filling method for moving and filling a container comprises moving said at least one seat along said movement trajectory bringing said at least one seat into a release position.

In this way it is possible to carry out a simplified and very efficient working process which allows to have the three desired working positions (i.e. removal, filling and release) in a single movement trajectory so that the equipment is able to carry out the filling operation autonomously and to move to the necessary positions in which to perform the envisaged operations.

In a third aspect thereof, the invention relates to an article production apparatus comprising at least one movement and filling unit which is constructed in accordance with the aforesaid first aspect.

In at least one of the above-mentioned aspects, the present invention may also have at least one of the preferred features described below.

Preferably, said movement device comprises a rotary kinematic mechanism which is secured to said frame with possibility to rotate with respect to said frame and having a vertical rotation axis.

Preferably, said housing is integrally secured to said rotary kinematic mechanism.

Preferably, said at least one seat is positioned with predetermined radial spacing from said rotation axis.

Preferably, said housing is configured in such a manner that while said pin rotates about said rotation axis said at least one seat defines said movement trajectory as a curved trajectory, in which there can be defined said removal position, said filling position and said release position.

In this way it is possible to easily and efficiently realise a movement device that allows the housing to reach the desired working positions by means of a single type of rotary movement.

In this sense, this instrumentation is easy to use and manage, ensuring high process reliability and precise operational control.

The great technical advantage offered is also related to the presence of an eccentric element, i.e. a device that rotates around an axis that is not its axis of symmetry. In other words, the radial spacing between the seat and the rotation axis of said rotary kinematic mechanism determines the possibility of moving the seat along a curved trajectory, and the definition, for example, of the aforesaid radial spacing thus defines the possibility of positioning the necessary working positions (i.e. removal, filling and releasing) with great freedom and process functionality.

It is therefore clear that being able to simply move the seat, and therefore the container received therein, carrying out the removal, the filling through a metering member that is already comprised in the moving member itself and the following release, also results in a significant reduction of the totality of the times of process of these processing steps.

Preferably, said movement device is configured to be movable along a circumferential arc.

This provides a simple and very effective version of a trajectory to follow.

This movement can be achieved, for example, by using a pin or a bearing. Preferably, such rotating kinematic mechanisms can also be made or operated by means of cam type mechanisms.

Thanks to this technical solution, the effect of providing a high stability and reliability to the movement device by applying a very effective type of movable constraint with limited and guaranteed degrees of freedom is also obtained.

Even more, the fact of providing that the rotation axis of said rotating kinematic mechanisms is vertical implies that the rotations produced along the movement trajectory are on a horizontal plane perpendicular to said vertical rotation axis and that thanks to this solution and to the constant constraint produced by the force of gravity acting on the filling product, it is possible to minimise the quantity of filling product that can inadvertently exit the container during the envisaged movements.

Preferably, said filling product is in the form of powder or granules.

This facilitates both the storage of the desired product and the filling of the container with the same product.

Preferably, said filling product is in the form of powdered coffee.

This makes both filling by means of the metering member and the movement step particularly effective.

Preferably, said metering member comprises a feed screw.

In this way, by simply rotating the feed screw it is possible to release a precise and predetermined quantity of filling product, in particular if the latter is in the form of powder or granules.

Preferably, said housing comprises a plurality of seats which are aligned along said movement trajectory.

This makes it possible to fill more than one container during a single process by means of a single movement and filling equipment.

This technical solution becomes particularly interesting and advantageous considering that the increase in productivity provided by the increase in processable seats allows to advance the movement and filling method in its entirety at lower speeds than those used in the prior art, guaranteeing a high production yield.

This is useful to further guarantee to avoid or limit very undesirable movements of the filling product once it is positioned in the container which is still open at the top and therefore not confining its contents in this direction.

Preferably, said plurality of seats is equal to 2.

This condition represents an ideal balancing solution between the steric overall space of the equipment and the increase in productivity.

Preferably, said movement device comprises a first motor element which allows said rotary kinematic mechanism to be rotated in the clockwise and counter-clockwise direction.

The Applicant has found that thanks to this technical solution it is possible to ideally reduce the movements that are necessary to ensure that all the seats present pass under the release opening of the metering member and that therefore can be effectively filled.

Furthermore, thanks to this technical solution, it is possible to reduce the spaces required to use said movement and filling equipment, as it is not necessary to make a complete 360° rotation around its individual rotation axis of the movement device, but it is possible to have it go back by travelling again the path already taken, thus limiting the extension of the curved line to be covered.

Preferably, said movement and filling equipment comprises a plurality of metering members.

The Applicant has noted that thanks to this technical solution it is possible to reduce the filling times in the case in which there is a plurality of seats.

Alternatively, thanks to this technical solution it is also possible to fill a plurality of containers with a single metering member, thus reducing the costs of the unit.

Preferably, the plurality of metering members can be arranged along the movement trajectory and at respective seats in which respective containers are housed.

Preferably, said movement device comprises a second motor element which is suitable for moving said housing vertically in translation so that there is produced a movement of said at least one seat which defines a first maximum vertical spacing position between said at least one seat and said release opening and a second minimum vertical spacing position between said seat and said release opening.

Thanks to this solution, it is possible to effectively bring the seat closer to the metering member, producing the benefit of achieving a more effective release of filling product inside the container and only inside the container, and also allowing a predetermined pressure on the powder dispensed by the metering member itself.

In fact, by deciding the extension of the minimum vertical spacing between said seat and said release opening, it is possible to decide what force to impart on the powder dispensed inside the container.

Alternatively, this minimum spacing can also be considered from the base of the container to the release opening of the metering member.

Preferably, this release opening is defined in a filling element comprised in said metering member and having a substantially cylindrical shape.

Preferably, said filling element comprises a lower edge acting as a circular crown within which said release opening is defined.

Preferably, said release opening has a diameter smaller than a maximum diameter of said container.

Even more preferably, said release opening has a diameter between 0.4 and 0.8 times the maximum diameter of said container, further preferably between 0.6 and 0.7.

Preferably, the filling element comprises a shutter which is capable of reversibly and selectively closing said release opening so that it also exerts the desired pressure on the powder contained in the container.

Preferably, said movement device comprises a second motor element which is suitable for reversibly moving said rotary kinematic mechanism and/or said housing in translation along said rotation axis so that there is produced a general rotational-translational movement of said at least one seat with respect to said rotation axis which defines a first maximum spacing position between said at least one seat and said release opening and a second minimum spacing position between said seat and said release opening.

The Applicant has found this technical solution to be an effective and simple way of producing the desired vertical movement in translation and thus being able to cover the desired movement trajectory.

Preferably, said second motor element is a piston or an electric motor connected to a belt or similar technical solution.

Preferably, said housing comprises a body having a substantially box-shaped development including said at least one seat and a laminar extent which is connected to said body and integrally secured to said rotary kinematic mechanism.

In this way, the desired eccentric movement of the seats with respect to the vertical rotation axis can be carried out, by minimising the weight of the housing and thus making the equipment used more usable, profitable and durable.

Preferably, said movement and filling unit comprising a transporter on which said movement and filling equipment is received.

In this way, the movement and filling equipment can be moved further into space, allowing it to be brought into positions where the exchange of the container with other processing equipment is facilitated.

Preferably, said transporter is a rotary carousel.

In this way, the transporter used returns to the same reference position after a 360° rotation.

Thanks to this technical solution, it is possible to realise a carousel that removes and releases the containers filled with the desired product quickly, effectively and minimising the relative movement times.

Preferably, said transporter comprises a plurality of movement and filling equipments.

In this way it is possible to further increase the productivity of the movement and filling unit.

Preferably, said seat and said container, when received in said seat, move by means of said transporter with a continuous movement.

Preferably, said transporter moves at a constant speed.

The Applicant has found that thanks to this technical solution it is possible to carry out the desired working process in a continuous manner, i.e. by keeping the system always in motion so that the operations produced by the equipment are carried out while it moves uniformly in the space according to its constraint with the transporter.

In fact, in this way it is possible to activate the related kinematic mechanisms with lower accelerations and decelerations than to what is necessary in the state of the art since all the devices envisaged by the process are comprised in the moving member and move consistently therewith.

This technical solution means that the sum of the times of the single steps of the movement and filling process is shorter than those obtainable with the intermittently operating known technique, producing also an increase in the average life of the mechanical parts used, since they are not subject to sudden accelerations and decelerations.

It is in fact important to note that the approach adopted in this case by the Applicant appears to be opposite to the one that envisages that the metering member is always in fixed positions in order to minimise powder dispensing errors. This operating condition arises from the fact that the Applicant has carried out targeted and in-depth studies aimed at verifying that a metering member moving in space is able to operate correctly and reproducibly if it does so with constant speeds, and therefore does not undergo significant accelerations or decelerations.

Preferably, at least one between said removal position and said release position is defined to be radially more distal than said filling position with respect to a rotation axis of said rotary carousel.

Preferably, this removal or release position is defined to be radially more distal than the maximum diameter of said rotary carousel.

The Applicant has found that when said removal and/or release position is/are realised outside the volume occupied by the movement and filling equipment and of the rotary carousel in a position radially more distal with respect to the centre of the rotary carousel itself, this condition allows easier and more efficient exchanges with preceding and/or following processing devices.

In fact, this technical solution allows reducing the risk of collisions of moving parts between the aforesaid devices, considerably increasing the safety of the processes adopted.

Preferably, said movement and filling method for moving and filling comprises providing said movement and filling unit, wherein said movement device comprises a rotary kinematic mechanism which is secured with permitted rotation with respect to said frame and having a vertical rotation axis.

Preferably, said housing is integrally secured to said rotary kinematic mechanism.

Preferably, said at least one seat is positioned with predetermined radial spacing from said rotation axis.

Preferably, said housing is configured such that as said rotary kinematic mechanism rotates about said rotation axis said at least one seat defines said movement trajectory as a curved trajectory, in which there can be defined said removal position, said filling position and said release position.

Preferably, said movement of said housing at said removal position is carried out by rotating said housing which is integrally secured thereto by means of said rotary kinematic mechanism.

Preferably, said movement of said at least one seat into said filling position is carried out by rotating said at least one seat about said rotation axis of said rotary kinematic mechanism.

Preferably, said movement of said at least one seat into said release position is carried by rotating said at least one seat about said rotation axis of said rotary kinematic mechanism.

Thanks to this technical solution it is possible to realise an effective and functional movement trajectory by means of a stable and reliable movement device.

Preferably, said filling product is in the form of powder or granules.

Preferably, said method comprises moving in translation said at least one seat upwards along said rotation axis.

In this way it is possible to carry out both a more precise and effective filling of the container and to produce a desired pressure on the released powder.

Preferably, said movement and filling unit comprises a transporter on which said movement and filling equipment is received.

Preferably, said method comprises the fact that said at least one seat is moved with continuous movement.

Preferably, said method comprises the fact that said housing comprises a plurality of seats which are all positioned along said movement trajectory.

Preferably, said method comprises the fact that said rotary kinematic mechanism is configured to rotate both in the clockwise and anti-clockwise direction in a selectively alternating manner.

In this way different types of movement and filling sequences can be realised.

Preferably, said method comprises the fact that said rotary kinematic mechanism rotates in a first direction in order to bring said plurality of seats at said removal position, at said position for filling a first seat, at said position for filling a second seat and then rotates in the opposite direction to bring said plurality of seats into respective release positions.

The Applicant has found that thanks to this technical solution it is possible to ideally reduce the movements necessary to ensure that all the seats present pass at the filling position in which said metering member releases the predetermined quantity of filling product.

Furthermore, thanks to this technical solution, it is possible to reduce the spaces required to use said movement and filling equipment, as it is not necessary to make a complete rotation of the movement device, but it is possible to have it go back by travelling again the path already taken, thus limiting the extension of the curved line to be covered.

Alternatively, said rotary kinematic mechanism rotates in a first direction to bring said plurality of seats at said removal position, at said position for filling a second seat, then rotates in the opposite direction in order to bring a first seat into said filling position and by continuing said direction of rotation, brings said plurality of seats into respective release positions.

In this embodiment, said first seat is the radially most proximal seat to the centre of the rotary carousel when said movement and filling equipment is tangentially aligned with the rotary carousel.

Thanks to this technical solution it is possible to ensure that both capsules filled with coffee make the least possible movement before reaching the release position. In this way, therefore, the possibility that some coffee positioned inside the capsules 10 can inadvertently spill out is minimised.

The characteristics and advantages of the invention will become clearer from the detailed description of an embodiment shown, by way of non-limiting example, with reference to the appended drawings wherein.

Figure 9:
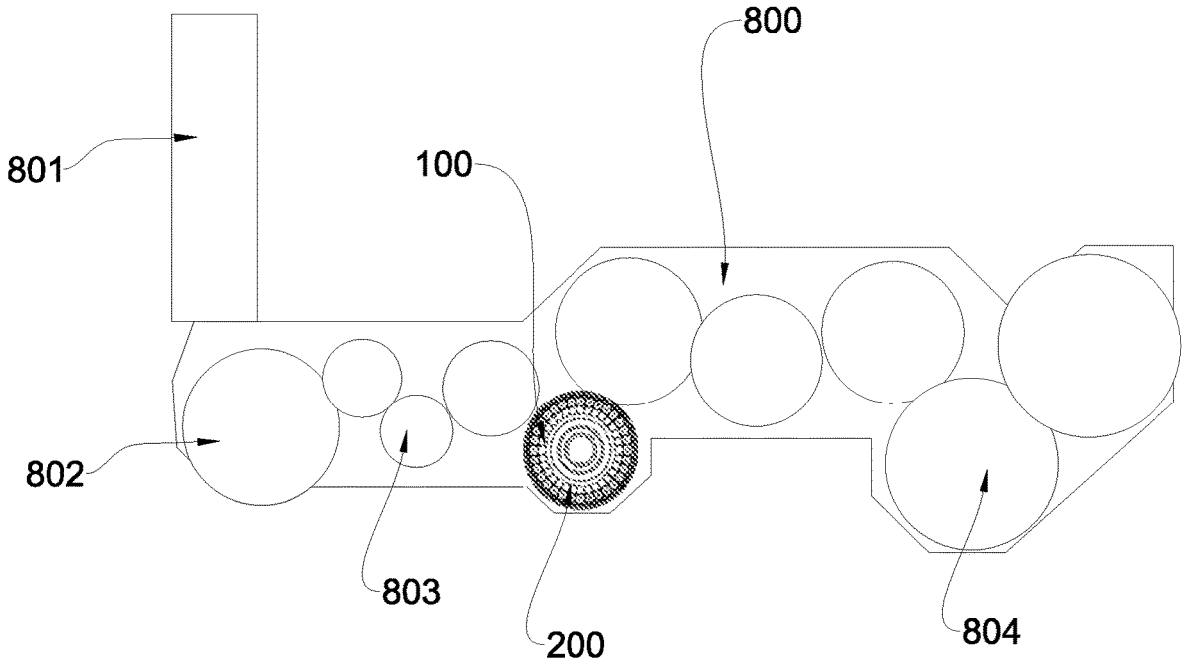
FIG. 9 is a schematic view from above of an article production apparatus comprising the movement and filling unit of FIG. 1.

With initial reference to FIG. 9, 800 refers to an article production apparatus which is provided to form and fill a container with a desired product, so as to obtain a finished container, ready to be packaged or used.

The embodiment example that will be described below refers to containers 10 in the form of capsules which are filled with a desired product.

In the specific case described herein, the containers 10 are capsule type elements for the preparation of beverages for infusion, in particular coffee capsules. More specifically, the filling product placed inside the capsule is coffee powder.

Figure 8:
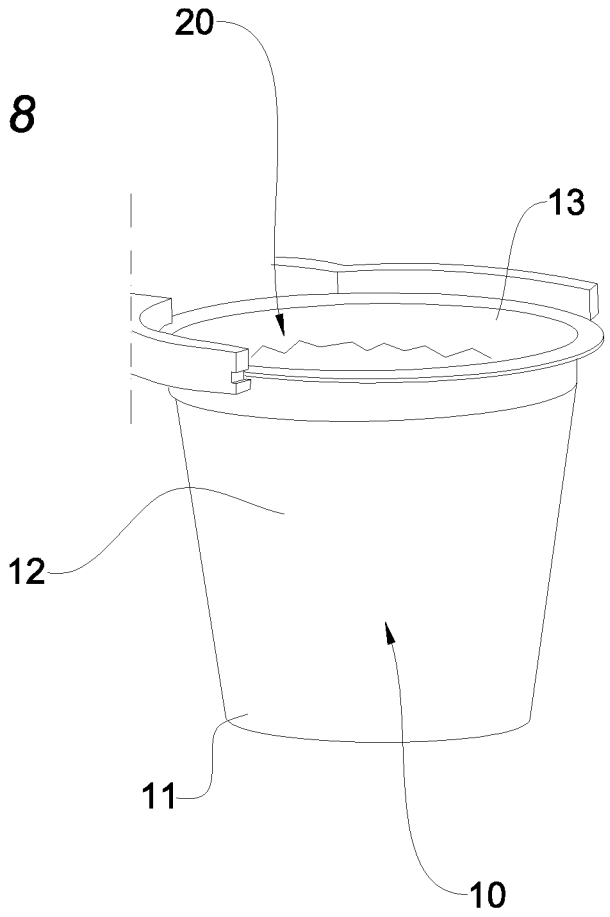
FIG. 8 is a schematic perspective view of a container used by the movement and filling unit of FIG. 1.

In the present example and as depicted in FIG. 8, the capsule 10 has a substantially upturned truncated conical shape presenting a base 11 of substantially flat and circular shape from which a lateral wall 12 is transversely projected.

This lateral wall 12 is inclined with respect to the vertical line having the smaller diameter thereof at the base 11 and the larger diameter thereof at an upper opening 13.

Again with reference to FIG. 8, it can be noted how the capsule 10 comprises inside it a filter 20 that is integrally secured thereto.

In the examples given herein, the filling product will be positioned inside the capsule 10 and more precisely inside the filter 20.

The apparatus 800 comprises, in its most general lines, a feeding unit 801 for the capsules 10, at empty state, a shaping unit 802 for shaping the filter 20 to be coupled to the capsule 10, a coupling unit 803 for coupling the filter 20 to the capsule 10, a movement and filling unit 100 for moving and filling the capsules 10 and, finally, a closing unit 804 for closing the capsule 10 with a closing membrane.

The movement and filling unit 100 of the container 10, shown in detail in FIGS. 1 to 7, comprises a movement and filling equipment 1, in turn comprising a frame 2 and a metering member 50 which is configured to release a predetermined dose 59 of the filling product by means of a release opening 51.

Such a metering member 50 preferably comprises a feed screw (not shown in the figures) which allows by means of its predetermined rotation to release a desired quantity of filling product.

By way of non-limiting example, it is reported that the dose 59 of coffee powder is between 5 and 18 grams.

The feed screw is positioned integral with the rotation unit and does not perform relative movements in order to minimise unwanted and unnecessary vibrations that could produce an unexpected release of the filling product.

Again with reference to FIGS. 1-7, the movement and filling equipment 1 comprises a movement device 30 which is secured with an ability to move with respect to said frame 2 and a housing 40 comprising at least one seat 41 and which is secured to the movement device 30.

This seat 41 preferably has the form of a hollow with a circular cross-section and a diameter which is intermediate between the minimum diameter of the base 11 of the capsule and the maximum diameter of the upper opening 13 so as to be able to house inside it at least partially said capsule 10, securing it in a stable manner at least according to movements which take place along a substantially horizontal plane.

Figure 6:
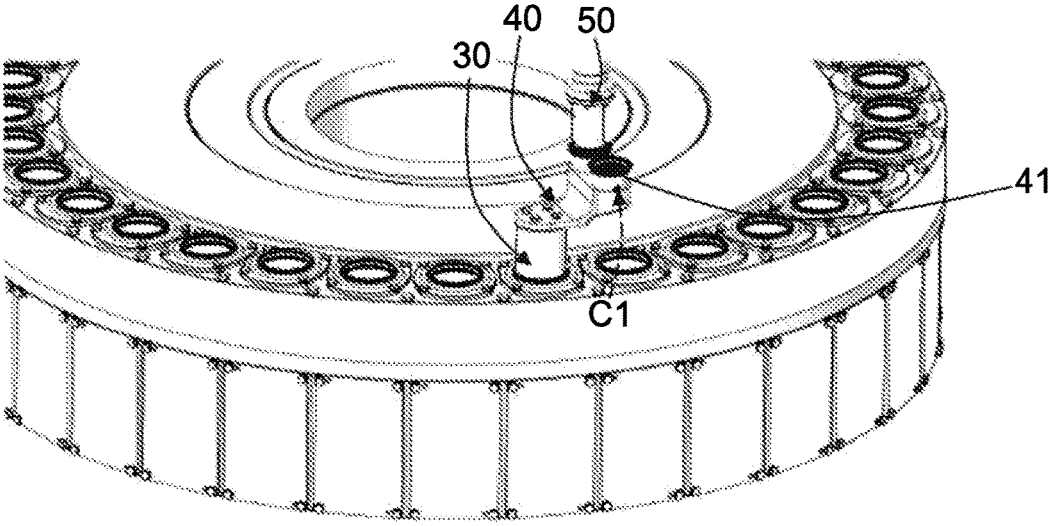

With reference to FIG. 6, the movement device 30 is configured to move the at least one seat 41 along a movement trajectory in which there can be defined:

- A removal position Pp (see FIG. 7) in which said container 10 is housed in said at least one seat 41,
- A filling position Pr (see FIGS. 3, 4 and 7) in which said seat 41 is vertically aligned in a position under said release opening 51 of the metering member 50,
- A release position Pri (see FIG. 7) in which said container 10 with said product is removed from said at least one seat 41.

Figure 1:
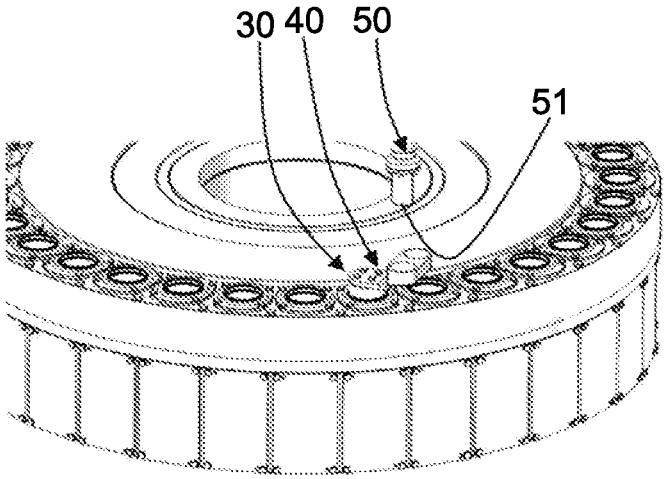
FIG. 1 is a schematic perspective view of a movement and filling unit made in accordance with the present invention.
Figure 2:
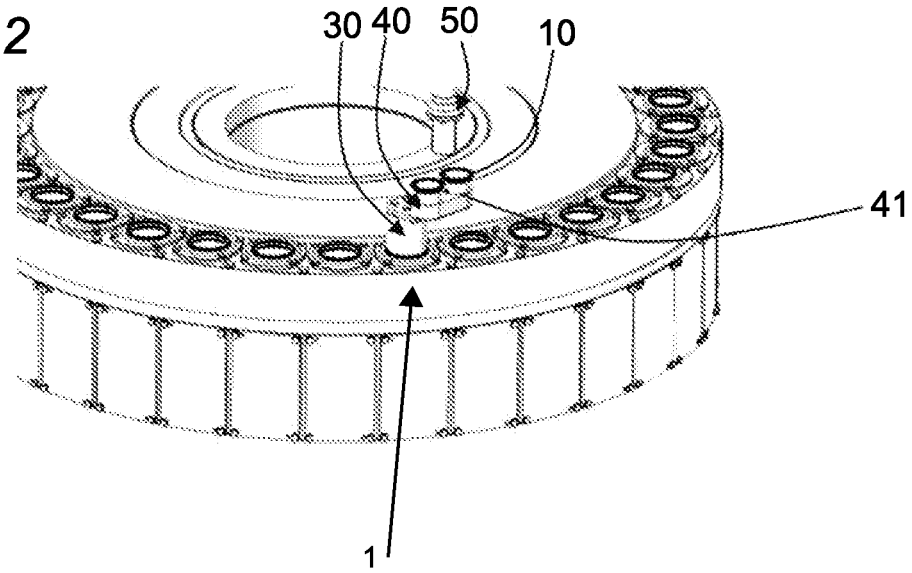
FIGS. 2 to 6 are schematic perspective views of the movement and filling unit of FIG. 1 in different operating positions.
Figure 3:
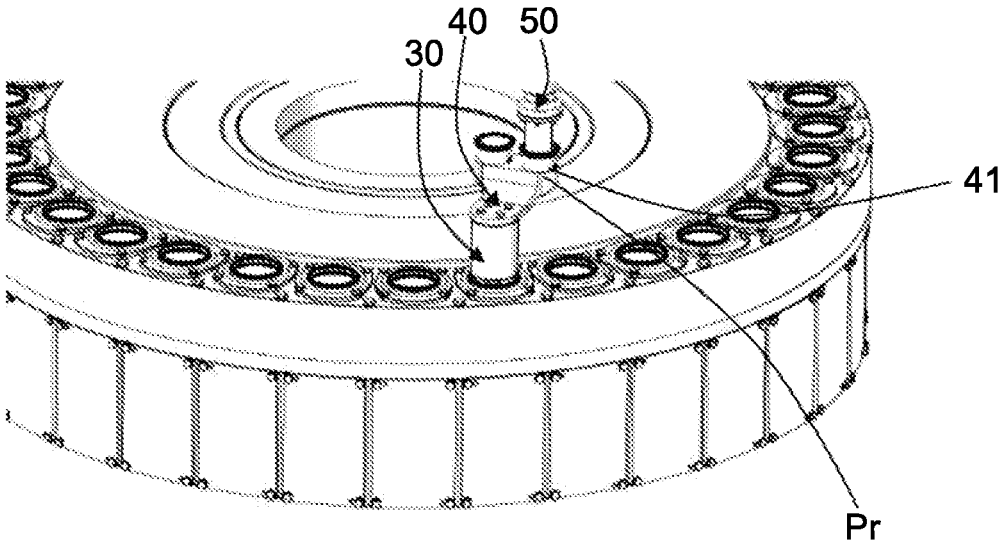
Figure 4:
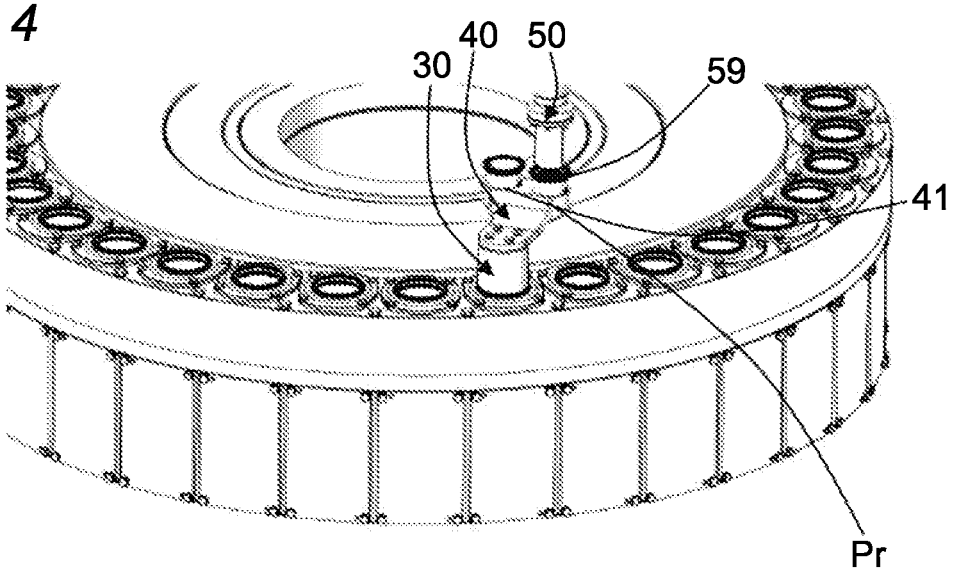
Figure 5:
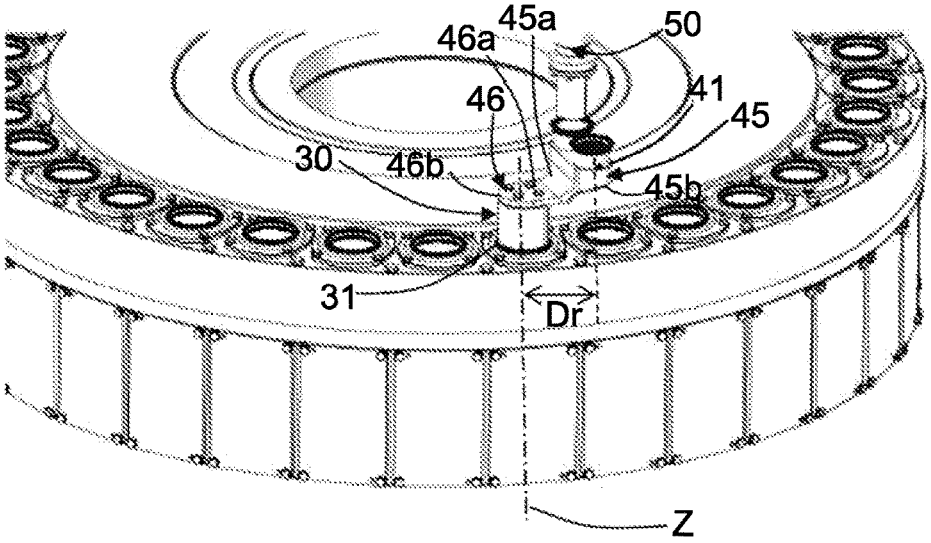

As shown in FIG. 5, the movement device 30 comprises a rotary kinematic mechanism 31 which is secured with permitted rotation with respect to the frame 2 and having a vertical rotation axis Z.

Preferably, this rotary kinematic mechanism 31 is a pin or a bearing or a cam type mechanism.

Alternatively, such a movement device 30 can be a slide sliding on a rail.

In this sense, therefore, the movement device 30 can be moved either along a straight line or along a curved line passing through the aforementioned three process positions Pp, Pr, Pri.

More specifically, if the movement device 30 is moved along a straight line, it can move in both directions and thus reach the desired positions, whereas in the case of a curved line, this movement can be performed by means of simple rotation (therefore, for example, according to a circumferential arc) or complex rotation (for example, by means of levers or cams producing an elliptical movement or similar).

Again with reference to FIG. 5, the housing 40 is shown integrally secured to the pin 31.

Furthermore, it is noted that the at least one seat 41 is positioned with a predetermined radial spacing Dr from said rotation axis Z.

Preferably, the housing 40 is configured in such a manner that while said pin 31 rotates about the rotation axis Z the at least one housing 41 defines the movement trajectory as a curved trajectory, in which there can be defined said removal position Pp, said filling position Pr and said release position Pri.

Thanks to this arrangement, the capsule 10 can be rotated around the rotation axis Z, minimising the possibility of spilling out the powdered coffee deposited therein.

Considering FIGS. 1 to 7, it can be noted that the movement and filling unit 100 comprises a transporter 200 having the shape of a rotary carousel.

Figure 7:
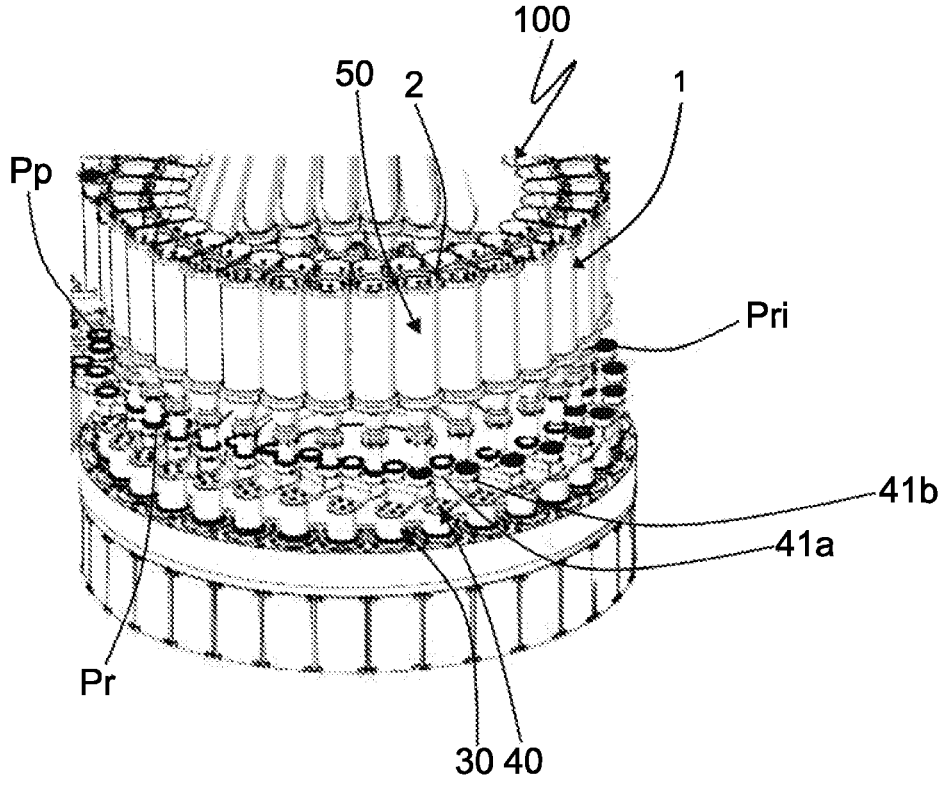
FIG. 7 represents a schematic perspective view of the movement and filling unit of FIG. 1 comprising a plurality of movement and filling equipments.

In particular, with reference to FIG. 7, it can be noted that the removal position Pp, and the release position Pri are radially more distal with respect to the filling position Pr and external with respect to the rotary carousel. Such a configuration is made possible thanks to the studied shape of the housing 40 having the radial spacing Dr which is defined so as to bring the at least one seat 41 outside the vertical projection of the base of the movement and filling unit 100 thus facilitating the exchange of the capsule with further interacting devices.

In fact, it is clearly noted that it is sufficient to rotate the pin 31 to have the capsule 10 cover the desired process positions.

Again with reference to FIG. 5, it is noted that the housing 40 comprises a body 45 having a substantially box-shaped development including the at least one seat 41 and a laminar extent 46 which is connected to the body 45 and rigidly secured to the pin 31.

This laminar extent 46 is connected at a first end 46*a* thereof to said body 45 by means of a transversal portion 45*a* thereof which is inclined with respect to a vertical plane so as to position a base 45*b* of the body 45 at a level higher than the level at which a second end 46*b*, opposite to said first end 46*a*, of the laminar extent 46 ends.

In this way, when there is provided a plurality of movement and filling equipments 1, it is possible to position them very close together as the base 45*b* of the box-shaped body 45 of a first equipment 1 passes above the second end 46*b* placed on the pin 31 of a second, adjacent and following equipment 1. This solution makes it possible to optimise the spaces occupied by the various devices and to minimise the overall space required.

As specifically shown in FIG. 7 the movement and filling equipment 1 comprises a plurality of seats 41. In the case shown as an example for each movement and filling equipment 1 the seats are equal to two 41*a*, 41*b*.

Thanks to this solution both seats 41*a*, 41*b* will follow the movement trajectory each thus reaching the removal positions Pp, filling positions Pr and release positions Pri.

In particular, according to one embodiment, the pin 31 will be rotated in such a manner that it first rotates at the removal position Pp in which the two capsules 10 will be removed simultaneously, then it will bring a first seat 41*a* into a position which is aligned under the metering member 50 into the filling position Pr to receive the filling product, then it will bring a second seat 41*b* into a position which is aligned under the metering member 50 into the filling position Pr to further receive the filling product and finally it will bring both seats 41*a*, 41*b* at the release position Pri.

In more detail and with reference to FIG. 7, it can be noted that the seat 41*b* is the one placed radially more distal than the seat 41*a* when the equipment 1 is tangentially aligned with the rotary carousel 200.

In FIG. 7, only one metering member 50 is shown, but it is alternatively also possible to provide for a plurality of metering members 50 which are also arranged according to the movement trajectory so that all the capsules 10 can be filled with filling product at the same time.

Even more advantageously, the movement device 30 comprises a first motor element, not shown in the Figures, which allows the pin 31 to be rotated in the clockwise and/or anti-clockwise direction.

This first motor element is, for example, an electric motor or similar technical solutions.

According to one embodiment and again with reference to FIG. 7, the movement and filling equipment 1 starting from the removal position Pp in which it has removed the two capsules 10, rotates in a counter-clockwise direction (seen from above) bringing the seat 41*b* under the release opening 51 in order to fill it with the predetermined dose of coffee at the filling position Pr.

Thereafter, the movement and filling equipment 1 reverses the direction of rotation and by rotating in the clockwise direction it brings the seat 41*a* under the release opening 51 in order to fill it with the predetermined dose of coffee at the filling position Pr. At this point the movement and filling equipment 1 continues the rotation in the clockwise direction bringing the seats 41*a*, 41*b* at the release position Pri.

Again, the movement and filling equipment 1 continues to rotate in the clockwise direction until it returns to the removal position Pp. At this point, having removed the two capsules 10, it reverses the rotation direction by starting to move in the anticlockwise direction again towards the filling position Pr and proceeding iteratively in this direction.

With reference to FIGS. 1 to 7, the movement device 30 comprises a second motor element (not shown in the Figure) which is suitable for vertically moving in translation the housing 40 so that there is produced a movement of the at least one seat 41, which defines a first maximum vertical spacing position between the at least one seat 41 and the release opening 51 and a second minimum vertical spacing position between the seat 41 and the release opening 51.

In more detail, the second motor element is suitable for reversibly moving along the rotation axis Z the pin 31 and/or the housing 40 so that there is produced a general rotational-translational movement of the at least one seat 41 with respect to the rotation axis Z.

This type of complex rotational-translational movement is a helical-turn.

In this way, it is possible both to bring the base 11 of the capsule 10 closer to the opening of the metering member 51 during the step of release of the filling product, reducing the possibility of the powder exiting of the capsule, and to exert a slight pressure by the metering member 50 on the powder poured into the capsule 10 so as to make it more compact and more effectively transportable in the following process steps.

This second motor element is a piston which is secured to a lower portion of said pin 31 so as to be able to raise it reversibly upwards according to desired needs.

Again with reference to FIGS. 1 to 7, the movement and filling unit moves with a continuous movement, which means that although the movement device 30 stops at the filling position Pr, the movement of the transporter 200 never stops and proceeds in a constant manner so that the capsule 10 and the unit itself are never stationary with respect to a reference point that is external to the movement and filling unit 100.

The embodiment which provides for the presence of at least two seats 41*a*, 41*b* for housing 40 ensures that the rotation of the rotary carousel 200 is limited, while guaranteeing in any case a processability of up to about 1500 capsules per minute. In the example shown in FIG. 7 the plurality of movement and filling equipments 1 for a movement and filling unit 100 is equal to 32.

In fact, thanks to such a solution, the Applicant has found that it is possible to rotate the movement and filling unit 100 by carrying out a number of rotations per minute between 15 and 30, preferably between 20 and 25, thus giving a centrifugal force acting on the capsule lower than 0.9 G, more preferably between 0.3 and 0.8 G (e.g. 0.45 G), ideally reducing the movement of the powder outside the capsule 10.

The invention claimed is:

1. A movement and filling unit of containers, comprising a carousel rotatable on a first vertical axis on which a movement and filling equipment is mounted, the movement and filling equipment comprising:

a metering member configured to release a predetermined dose of a filling product by a release opening, a movement device moveably secured to said carousel and configured to rotate about a second vertical axis independently from said carousel, the second vertical axis being different than said first vertical axis, and a housing secured to said movement device, the housing comprising a plurality of seats and configured to rotate about the second vertical axis, wherein said movement device is configured to move said plurality of seats along a movement trajectory, the movement trajectory comprising:

a removal position in which said containers are housed in said plurality of seats, a filling position in which said plurality of seats are vertically aligned in a position under said release opening, and a release position in which said containers with said filling product are removed from said plurality of seats.

2. The movement and filling unit according to claim 1, wherein:

said movement device comprises a rotary kinematic mechanism rotatably secured to said carousel, the rotary kinematic mechanism rotating about the second vertical axis, wherein the second vertical axis is a vertical rotation axis passing through said housing, said housing is integrally secured to said rotary kinematic mechanism, said plurality of seats are positioned with a predetermined radial spacing from said second vertical axis, and said housing is configured in such a manner that while said rotary kinematic mechanism rotates about said second vertical axis, said plurality of seats define said movement trajectory as a curved trajectory comprising said removal position, said filling position and said release position.

3. The movement and filling unit according to claim 1, wherein said movement device is configured to be movable along a circumferential arc.

4. The movement and filling unit according to claim 1, wherein said filling product is in form of powder or granules.

5. The movement and filling unit according to claim 1, wherein said metering unit comprises a feed screw.

6. The movement and filling unit according to claim 1, wherein said movement device comprises a first motor element allowing said rotary kinematic mechanism to be rotated in clockwise and counter-clockwise directions.

7. The movement and filling unit according to claim 1, wherein said movement device comprises a second motor element configured for moving said housing vertically in translation to produce a movement of said plurality of seats defining a first maximum vertical spacing position between said plurality of seats and said release opening and a second minimum vertical spacing position between said plurality of seats and said release opening.

8. The movement and filling unit according to claim 2, wherein said movement device comprises a second motor element configured for moving said housing vertically in translation to produce a movement of said plurality of seats defining a maximum vertical spacing position between said plurality of seats and said release opening and a minimum vertical spacing position between said plurality of seats and said release opening.

9. The movement and filling unit according to claim 8, wherein said second motor element is configured for reversibly moving said rotary kinematic mechanism and/or said housing in translation along said second vertical axis, to produce a general rotational-translational movement of said plurality of seats with respect to said second vertical axis, defining a maximum spacing position between said plurality of seats and said release opening and a minimum spacing position between said plurality of seats and said release opening.

10. The movement and filling unit according to claim 1, wherein said plurality of seats and said containers, when housed in said plurality of seats, move through said carousel with continuous movement.

11. The movement and filling unit according to claim 1, wherein at least one between said removal position and said release position is defined to be radially more distal than said filling position with respect to said first vertical axis of said carousel.

12. A method for moving and filling containers, comprising:

(i) providing a movement and filling unit comprising a carousel rotatable on a first vertical axis on which a movement and filling equipment is mounted, the movement and filling equipment comprising:

a carousel rotating with the carousel around the first vertical axis, a metering member configured to release a predetermined dose of a filling product by a release opening, a movement device moveably secured to said carousel and configured to rotate about a second vertical axis independently from said carousel, the second vertical axis being different than said first vertical axis, a housing secured to said movement device, the housing comprising a plurality of seats and configured to rotate about the second vertical axis, wherein said movement device is configured to move said plurality of seats along a movement trajectory, the movement trajectory comprising:

a removal position in which said containers are housed in said plurality of seats, a filling position in which said plurality of seats are vertically aligned in a position under said release opening, and a release position in which said containers with said filling product are removed from said plurality of seats;

(ii) moving said housing to the removal position for each of said plurality of seats (iii) moving said housing to bring each of said plurality of seats into the filling position, (iv) releasing a desired dose quantity of a product inside each of said containers by said metering member, and (v) moving said plurality of seats along said movement trajectory into the release position.

13. The method according to claim 12, wherein:

said movement device comprises a rotary kinematic mechanism rotatably secured to said carousel, the rotary kinematic mechanism rotating about the second vertical axis, wherein the second vertical axis is a vertical rotation axis passing through said housing, said housing is integrally secured to said rotary kinematic mechanism, said plurality of seats are positioned with a predetermined radial spacing from said second vertical axis, said housing is configured in such a manner that while said rotary kinematic mechanism rotates about said second vertical axis, said plurality of seats define said movement trajectory as a curved trajectory comprising said removal position, said filling position and said release position, said movement of said housing at said removal position is performed by rotating said housing through said rotary kinematic mechanism, said movement of said plurality of seats into said filling position is performed by rotating said plurality of seats about said second vertical axis, and said movement of said plurality of seats into said release position is performed by rotating said plurality of seats about said second vertical axis.

14. The method according to claim 12, comprising moving in translation said plurality of seats upwards along said second vertical axis, thus compressing said filling product dispensed in said containers.

15. The method according to claim 12, wherein said rotary kinematic mechanism rotates in a first direction to bring said plurality of seats into said removal position, further rotates in the first direction to bring a first seat into said filling position, then rotates in a second direction opposite to the first direction to bring a second seat into said filling position, and further rotates in the second direction to bring said plurality of seats into respective release positions.

16. An article production apparatus comprising at least one movement and filling unit according to claim 1.

* * * * *